US010883071B2

(12) United States Patent
Cunningham et al.

(10) Patent No.: US 10,883,071 B2
(45) Date of Patent: Jan. 5, 2021

(54) CLEANING SOLVENT COMPOSITIONS AND THEIR USE

(71) Applicant: Zynon Technologies, LLC, New Britain, CT (US)

(72) Inventors: Wells Cunningham, New Hartford, CT (US); Elizabeth P. Norwood, Unionville, CT (US); Venesia L. Hurtubise, Naugatuck, CT (US)

(73) Assignee: ZYNON TECHNOLOGIES, LLC, New Britain, CT (US)

( * ) Notice: Subject to any disclaimer, the term of this patent is extended or adjusted under 35 U.S.C. 154(b) by 262 days.

(21) Appl. No.: 15/577,194

(22) PCT Filed: May 27, 2016

(86) PCT No.: PCT/US2016/034569
§ 371 (c)(1),
(2) Date: Jul. 17, 2018

(87) PCT Pub. No.: WO2016/196260
PCT Pub. Date: Dec. 8, 2016

(65) Prior Publication Data

US 2018/0216047 A1 Aug. 2, 2018

Related U.S. Application Data

(60) Provisional application No. 62/168,306, filed on May 29, 2015.

(51) Int. Cl.

| | |
|---|---|
| ***C11D 7/50*** | (2006.01) |
| ***C11D 1/00*** | (2006.01) |
| ***C11D 1/78*** | (2006.01) |
| ***C11D 1/825*** | (2006.01) |
| ***C11D 3/20*** | (2006.01) |
| ***C11D 3/24*** | (2006.01) |

(52) U.S. Cl.
CPC ..... *C11D 7/5018* (2013.01); *C11D 1/006* (2013.01); *C11D 1/78* (2013.01); *C11D 1/825* (2013.01); *C11D 3/201* (2013.01); *C11D 3/2006* (2013.01); *C11D 3/2017* (2013.01); *C11D 3/2034* (2013.01); *C11D 3/2041* (2013.01); *C11D 3/2044* (2013.01); *C11D 3/2048* (2013.01); *C11D 3/2058* (2013.01); *C11D 3/2065* (2013.01); *C11D 3/24* (2013.01)

(58) Field of Classification Search
CPC ... C11D 1/004; C11D 7/5018; C11D 3/38618; C11D 1/34
USPC ..... 8/142; 510/400
See application file for complete search history.

(56) References Cited

U.S. PATENT DOCUMENTS

| | | | | |
|---|---|---|---|---|
| 3,776,693 | A * | 12/1973 | Smith | C11D 3/38618 8/142 |
| 4,724,096 | A | 2/1988 | Figiel et al. | |
| 5,334,325 | A * | 8/1994 | Chaussee | A61K 8/042 424/43 |
| 5,856,286 | A | 1/1999 | Nalewajek et al. | |
| 5,908,822 | A | 6/1999 | Dishart | |
| 6,053,952 | A | 4/2000 | Kaiser | |
| 6,312,759 | B1 | 11/2001 | Yamada et al. | |
| 6,350,395 | B1 * | 2/2002 | Kuemin | C09K 15/30 252/390 |
| 6,660,709 | B1 * | 12/2003 | Dournel | C09K 5/045 252/67 |
| 8,410,039 | B2 | 4/2013 | Bartelt et al. | |
| 8,637,443 | B2 * | 1/2014 | Basu | C11D 1/004 510/400 |
| 2004/0117918 | A1 | 6/2004 | Scheper et al. | |
| 2004/0259752 | A1 | 12/2004 | Degroot et al. | |
| 2006/0052268 | A1 | 3/2006 | Artuphel et al. | |
| 2006/0200914 | A1 | 9/2006 | Evers et al. | |
| 2006/0217277 | A1 | 9/2006 | Lallier et al. | |
| 2007/0010421 | A1 | 1/2007 | Wu | |
| 2007/0203045 | A1 | 8/2007 | Schweitzer et al. | |
| 2008/0139444 | A1 | 6/2008 | Bartelt | |
| 2008/0274935 | A1 | 11/2008 | Dingess | |
| 2009/0186799 | A1 | 7/2009 | Owens | |
| 2012/0122996 | A1 | 5/2012 | Basu et al. | |
| 2015/0329806 | A1 | 11/2015 | Robin et al. | |

(Continued)

FOREIGN PATENT DOCUMENTS

| | | | | |
|---|---|---|---|---|
| JP | H 01139863 A * | 6/1989 | | C11D 1/34 |
| WO | 2012121749 A1 | 9/2012 | | |
| WO | 2014147311 A1 | 9/2014 | | |

OTHER PUBLICATIONS

"Phosphate Esters", Publication of Lakeland Laboratories Limited, Manchester, England, Ref: Lakeland Phos. Esters (4), 3/00, 12 pages.

(Continued)

*Primary Examiner* — Khanh T Nguyen
(74) *Attorney, Agent, or Firm* — Cantor Colburn LLP

(57) ABSTRACT

A cleaning solvent composition comprises from about 0.2 to 15 weight percent of mono- or di-phosphate ester in free acid form, and from about 85 to 99.8 weight percent of one or more halogenated hydrocarbon solvents. Other cleaning solvent compositions further comprise one or more alcohols. For example, such alcohol-containing compositions may comprise from about 0.2 to 15 weight percent of mono- or di-phosphate ester in free acid form, from about 2 to about 25 weight percent of one or more alcohols, and from about 25 to about 97.8 weight percent of one or more halogenated hydrocarbon solvents.

9 Claims, No Drawings

(56) References Cited

U.S. PATENT DOCUMENTS

| | | | |
|---|---|---|---|
| 2016/0023974 | A1 | 1/2016 | Bonnet et al. |
| 2016/0326468 | A1 | 11/2016 | Robin et al. |
| 2017/0283959 | A1 | 10/2017 | Shellef et al. |

OTHER PUBLICATIONS

International Search Report for Intemational Application No. PCT/US16/34569; International Filing Date May 27, 2016; dated Aug. 31, 2016; 7 pages.
Written Opinion for International Application No. PCT/US16/34569; International Filing Date May 27, 2016; dated Aug. 31, 2016; 8 pages.
Extended European Search Report dated Oct. 9, 2018, issued in European Patent Application No. 16804100.2, 7 pages.

* cited by examiner

CLEANING SOLVENT COMPOSITIONS AND THEIR USE

CROSS-REFERENCE TO RELATED APPLICATIONS

This application is a U.S. national stage application of International Application No. PCT/US2016/034569 entitled "Cleaning Solvent Compositions and Their Use", which has an international filing date of 27 May 2016, and which claims priority of provisional patent application Ser. No. 62/168,306 filed on May 29, 2015 in the name of Wells Cunningham et al. and entitled "Cleaning Solvent Compositions and Their Use".

BACKGROUND OF THE INVENTION

Field of the Invention

The present invention concerns solvent-based cleaning compositions of the type used in industrial processes for cleaning a wide variety of items including metals and plastics in the metal-working, electronics and other industries.

Description of Related Art

Solvent based cleaning compositions are used in industrial processes for cleaning a wide variety of soiling substances and residues (below sometimes referred to as "soils" or "soiling substances"). The electronics industry typically cleans fluxes, solder pastes, adhesives and coatings from a variety of devices before and after assembly of components. Such devices may comprise one or more of a wide range of materials comprising metal, ceramic and synthetic polymer (plastic) substrates and components. Metal working operations must remove lubricant oils and soaps, grinding media and greases from metal surfaces. Many of these soils are very difficult to strip from metal surfaces, especially with non-aqueous cleaners.

Of special interest are non-flammable blends of solvents that provide a cleaning solvent which can be used safely in aerosol packages, or as wiping fluids or in bulk cleaning tanks, for example, in vapor degreasing ("VDG") units. Typically, these cleaning solvents comprise halogenated compounds that are either non-flammable themselves or can be rendered non-flammable in a mixture with other halogenated compounds. Many solvent-based cleaning compositions rely heavily on the use of additives to target specific applications, that is, to remove specific soiling substances from various objects. A widely used class of additives is phosphate esters, known for use as anionic surfactants. For example, see *Phosphate Esters*, a technical brochure published by Lakeland Laboratories Limited of Manchester, England (Lakeland Phos. Esters (4), 3/00).

U.S. Pat. No. 4,724,096 to Figiel et al. issued on Feb. 9, 1988 discloses the use trichlorotrifluoroethane with butanol and aryl-ethoxylated phosphate ester acid form for drying formulations.

U.S. Pat. No. 5,856,286 to Nalewajek issued on Jan. 5, 1999 discloses surfactants for use in drying and dry cleaning compositions, in particular, surfactants which may be used with halocarbons including hydrochlorofluorocarbons and hydrofluorocarbons and hydrofluoroethers. As noted at column 1, line 54 et seq., the invention is premised on the discovery that placement of fluorine on the surfactant molecule is critical to surfactant solubility in the halogenated solvent compounds disclosed.

U.S. Pat. No. 5,908,822 to Dishart issued on Jun. 1, 1999 discloses compositions and processes for drying substrates in which the drying and/or cleaning compositions contain surfactants which are primary or secondary amine salts of various perfluoro hydrogen and dihydrogen phosphates.

U.S. Pat. No. 6,053,952 to Kaiser issued on Apr. 25, 2000 discloses a method of dry cleaning using a highly fluorinated organic solvent which contains at least one hydrogen atom per molecule, for example, highly fluorinated hydrocarbons or highly fluorinated ethers. In one embodiment, these compounds are combined with dichloroethylene and a surfactant may be included in the composition. These surfactants may comprise organic alkyl phosphate ester, dialkyl sodium succinate or isopropylamine alkyl benzene sulfonate. The use of phosphate ester salts in dry cleaning is disclosed.

U.S. Pat. No. 8,637,443 to Basu et al. issued on Jan. 28, 2014 discloses a dry cleaning method using a highly fluorinated organic solvent, such as hydrofluorocarbons (HFC) or hydrofluoroethers (HFE). For example, the combination of a fluorinated solvent containing at least one hydrogen atom with transdichloroethylene ("TDE") and a blend of surfactants including organic alkyl phosphate ester, dialkyl sodium succinates, isopropylamine alkyl benzene sulfonate is disclosed. The latter may be used with other surfactant ingredients in Vertrel® MCA Plus.

SUMMARY OF THE INVENTION

Generally, the present invention concerns cleaning solvent compositions whose components exhibit good mutual solvency and highly efficient cleaning. In one aspect, the cleaning solvent compositions of the present invention comprise one or more free acid forms of phosphate ester surfactants, one or more halogenated hydrocarbon solvents, and one or more alcohols.

Specifically, in accordance with the present invention there is provided a composition comprising from about 0.2 to about 15 weight percent of one or more free acid forms of phosphate ester surfactants selected from the group consisting of one or both of:

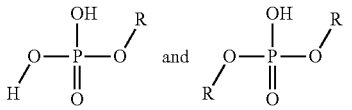

wherein R is selected from the group consisting of one or more of ethoxylated hydrocarbons, alkylated hydrocarbons, fluorinated hydrocarbons, and ethoxylated and fluorinated hydrocarbons;

from about 2 to about 25 weight percent of an alcohol selected from the group consisting of one or more of straight chain and branched alkyl alcohols, monohydric and polyhydric aromatic alcohols and monohydric and polyhydric heteroaromatic alcohols; and from about 25 to about 97.8 weight percent of one or more halogenated hydrocarbon solvents.

Another aspect of the present invention provides that R is one or more of

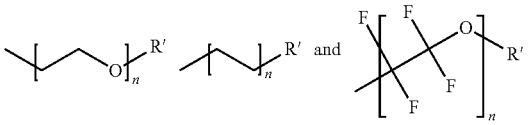

R' is one or more of H, $CH_3$, an alkyl group and an aryl group; and n is an integer from 2 to 20, for example, n is an integer from 2 to 5.

In another aspect of the present invention the alcohol is selected from the group consisting of one or more of methanol, ethanol, isopropanol and n-butanol.

Another aspect of the present invention provides that the one or more halogenated hydrocarbon solvents are selected from the group consisting of one or more of perfluorocarbons ("PFCs"), chlorofluorocarbons ("CFCs"), hydrofluorocarbons ("HFCs"), hydrofluoroethers ("HFEs"), hydrofluoroolefins ("HFOs"), partially brominated hydrocarbons, fully brominated hydrocarbons, partially chlorinated hydrocarbons and fully chlorinated hydrocarbons.

Another aspect of the present invention provides a composition comprising from about 0.2 to about 15 weight percent of one or more free acid forms of phosphate ester surfactants selected from the group consisting of:

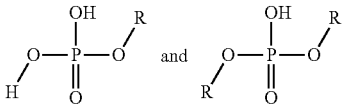

wherein R is selected from the group consisting of one or more of ethoxylated hydrocarbons, alkylated hydrocarbons, fluorinated hydrocarbons, and ethoxylated and fluorinated hydrocarbons; and from about 85 to about 97.8 weight percent of a halogenated hydrocarbon solvent.

Yet another aspect of the present invention provides that in the two-component (phosphate ester and halogenated hydrocarbon composition), R is one or more of

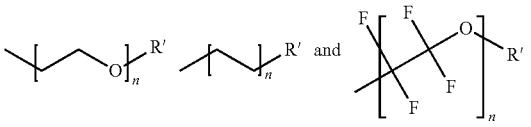

R' is one or more of H, $CH_3$, an alkyl group and an aryl group; and n is an integer from 2 to 20, for example, n is an integer from 2 to 5.

Another aspect of the present invention provides that in the two-component composition, the halogenated hydrocarbon solvent is selected from the group consisting of one or more of perfluorocarbons ("PFCs"), chlorofluorocarbons ("CFCs"), hydrofluorocarbons ("HFCs"), hydrofluoroethers ("HFEs"), hydrofluoroolefins ("HFOs"), partially brominated hydrocarbons, fully brominated hydrocarbons, partially chlorinated hydrocarbons and fully chlorinated hydrocarbons.

Other aspects of the present invention will be apparent from the following description. For example, the compositions of the invention may include a non-halogenated hydrocarbon solvent.

DETAILED DESCRIPTION OF THE INVENTION AND SPECIFIC EMBODIMENTS THEREOF

The following abbreviations, trademarks and trade names have the following meanings, whether used in the singular or plural form.

Solvent Formulations

"TDE". Trans-Dichloroethylene, Chemical Abstracts Number ("CAS #") 156-60-5.

"HFCs". Hydrofluorocarbons such as HFC 43-10me, sold under the trademark Vertrel® XF, CAS #1384-95-42 and HFC365mfc CAS #406-58-6. These materials are available from E.I. DuPont de Nemours and Co. of Wilmington, Del.

"HFEs". Hydrofluoroethers such as HFE 7100, CAS #163702-08-7 and 163702-07-6.

"NPB". n-Propyl bromide, CAS #106-94-5.

"Vertrel® SFR". A blend of 67% trans-dichloroethylene, 18% 2,3-dihydrodecafluoropentane (HFC 43-10me); 12% heptafluorocyclopentane; 3% methanol. This material has a boiling point of 106° F. (41.1° C.) and is available from E.I. DuPont de Nemours and Co. of Wilmington, Del.

"SION". A blend of 96% trans-dichloroethylene and 4% methylperfluorohexene (HFX-110). This material has a boiling point of 121° F. (49.4° C.) and is available from E.I. DuPont de Nemours and Co. of Wilmington, Del.

"CMS". A blend of 41.5% trans-dichloroethylene, 18% HFC 365mfc, 37% 2,3-dihydrodecafluoropentane (HFC 43-10me), 3.5% methanol. This material has a boiling point of 97° F. (36.1° C.) and is available from MicroCare Corporation of New Britain, Conn., an affiliated company of the assignee of this application.

"MCA". A blend of 62% trans-dichloroethylene, 38% 2,3-dihydrodecafluoropentane (HFC 43-10me). This material has a boiling point of 102° F. (38.9° C.) and is available from E.I. DuPont de Nemours and Co. of Wilmington, Del.

"SDG". A blend of 83% trans-dichloroethylene, 7% 2,3-dihydrodecafluoropentane (HFC 43-10me); 10% hexafluorocyclopentane. Bp 109F. This material has a boiling point of 109° F. (42.8° C.) and is available from E.I. DuPont de Nemours and Co. of Wilmington, Del.

"Vertrel® XP". A blend of 96.75% 2,3-dihydrodecafluoropentane (HFC 43-10me), 3.25% isopropanol. This material has a boiling point of 126° F. (52.2° C.) and is available from E.I. DuPont de Nemours and Co. of Wilmington, Del.

"CFCs". Chlorofluorocarbons such as those sold under the trademark Solstice, for example, trans-chlorotrifluoromethyl propene CAS #2730-43-0. This material has a boiling point of 68° F. (20° C.) and is available from Honeywell International of Morristown, N.J.

"DBE". A blend of dimethyl succinate, glutarate and adipate having a boiling point of >250° F. (121.1° C.) is available from Invista of Wichita, Kans.

Phosphate Esters

"Capstone FS-66". A fluorinated alkyl substituted phosphate ester in free acid form, available from E.I. DuPont de Nemours and Co. of Wilmington, Del.

"Rhodafac RS710". An ethoxylated alkyl substituted phosphate ester in free acid form, available from Solvay Rhodia which has a place of business in Houston, Tex.

Soiling Substances

"No-Clean Lead-Free Solder Pastes" available from Alpha Corporation of Altoona, Pa. and Suwanee, Ga. under the designation Omnix 340, or from Nihon Almit Co. Ltd. of Tokyo, Japan under the designation SN62U. Additional fluxes and pastes as are used in the industry are: AIM Corporation 217 Gel Flux, NC Paste Flux (257), NC Flux Pen (280), M8 Paste, RMA258-15R and Loctite Corporation GC3 (Water Soluble), Loctite GC10 and Alpha Corporation OM340 and Indium Corporation 8.9HF1 and SMQ92-J (Leaded).

Standard Procedure.

A stencil was made with 3-mm holes, a 3-mm pitch (edge-to-edge distance between holes) and a 0.075 mm thickness. Flux or solder paste were stencil printed onto 7.62×15.24 mm (3 inch×6 inch) steel panels creating a test array of 3-mm diameter by 0.075 mm high dots of paste. The paste dots were then reflowed by placing the steel plates in a 350° C. oven for 4 minutes or by passing through an Aminstrument T-962A benchtop reflow oven set to achieve 350° C. maximum for 2 minutes. Cleaning trials were conducted in standard 2-sump vapor degreasers or in bench top simulation using beakers of boiling cleaning solvent blend after which the cleaned dots were rinsed in an ambient rinse solution that did not contain phosphate esters. The following examples report the results of cleaning trials conducted pursuant to this Standard Procedure.

In the following Examples 1-6, the types of components ("Component Type") of each Cleaning Formulation tested is indicated by abbreviations in parentheses. The abbreviations are: "HHC"=halogenated hydrocarbon solvents; "NHH"=non-halogenated hydrocarbon solvents; "ALC"=alcohol; "FAPE"=free acid phosphate ester; and "HFE"=hydrofluoroether solvents. Unless otherwise stated, all references herein to the percentage of a component in a composition are percent by weight of the total weight of the composition.

Example 1. Chlorofluorocarbon Based Solvents Used to Clean "No-Clean" Solder Pastes as the Soiling Substance

| Trial | Cleaning Formulation (Component Type) | Cleaning Process | Observation |
|---|---|---|---|
| 1 | 100% Solstice (HHC) | 20 minutes boil | Rosin binder of flux mostly removed but significant white residue remains. |
| 2 | 97% Solstice 3% Rhodafac RS710 (HHC, FAPE) | 20 minutes boil/ 1 minute rinse with Solstice | Rosin binder of flux mostly removed but some white residue remains. |
| 3 | 95% Solstice 5% DBE (HHC, NHH) | 20 minutes boil/ 1 minute rinse with Solstice | Rosin binder of flux mostly removed but significant white residue remains. |
| 4 | 90% Solstice 5% DBE 5% Rhodafac RS710 (HHC, NHH, FAPE) | 20 minutes boil/ 1 minute rinse with Solstice | Rosin binder of flux mostly removed but some white residue remains. |
| 5 | 97% Solstice 3% methanol (HHC, ALC) | 20 minutes boil/ 1 minute rinse with Solstice | Rosin binder of flux mostly removed but some white residue remains. |
| 6 | 95% Solstice 3% methanol 2% Rhodafac RS710 (HHC, ALC, FAPE) | 20 minutes boil/ 1 minute rinse with Solstice | All flux residue removed leaving clean solder balls behind. |
| 7 | 97% Solstice 3% methanol 3% Capstone FS-66 (HHC, ALC, FAPE) | 20 minutes boil/ 1 minute rinse with Solstice | All flux residue removed leaving clean solder balls behind. |

No-clean Solder Pastes contain organic binders or rosins in which are dispersed the solder and the surface activating components which help bond the solder to a substrate. The results of Example 1 show that especially in lead free, "no clean" systems, the binders can often be removed with existing cleaning formulations but the activators will be left behind leaving a characteristic white residue on the part. Addition of an alcohol to the cleaning composition (trial 5) is seen to help start removal of the ionic white residues but does not adequately clean the part. Trials 6 and 7 dramatically illustrate that the synergy of combining CFC, methanol and a phosphate ester acid successfully removes flux residue. Trials 3 and 4 show the importance of an alcohol component because substituting the strong organic solvent DBE for the methanol did not provide the desired results.

Example 2. HFC/TDE Blends Used to Clean Rosin Metal Activating ("RMA") Solder Pastes as the Soiling Substance

| Trial | Cleaning Formulation (Component Type) | Cleaning Process | Observation |
|---|---|---|---|
| 8 | 100% Sion (HHC) | 10 minutes boil | Paste mostly removed but a dull finish left on the steel. |
| 9 | 97% Sion 3% Rhodafac RS710 (HHC, FAPE) | 10 minutes boil/ 1 minute rinse with Sion | Paste completely removed and steel significantly brightened. |
| 10 | 100% SDG (HHC) | 10 minutes boil | Paste mostly removed but a dull finish left on the steel. |
| 11 | 97% SDG 3% Rhodafac RS710 (HHC, FAPE) | 10 minutes boil/ 1 minute rinse with SDG | Paste completely removed and steel significantly brightened. |
| 12 | 100% Vertrel ® SFR (HHC, ALC) | 10 minutes boil | Paste mostly removed but a dull finish left on the steel. |
| 13 | 97% Vertrel ® SFR 3% Rhodafac RS710 (HHC, ALC, FAPE) | 10 minutes boil/ 1 minute rinse with SFR | Paste completely removed and steel significantly brightened. |
| 14 | 100% CMS (HHC, ALC) | 10 minutes boil | Paste mostly removed but a dull finish left on the steel. |
| 15 | 97% CMS 3% Rhodafac RS710 (HHC, ALC, FAPE) | 10 minutes boil/ 1 minute rinse with CMS | Paste completely removed and steel significantly brightened. |

The results of Trials 9 and 11 of Example 2 show that excellent results were obtained without the use of alcohol as a co-solvent for the halogenated solvent component. Trials 13 and 15 show that addition of a phosphate ester acid to a cleaning composition containing alcohol and a halogenated hydrocarbon content will complete the cleaning process as well as achieve significant metal brightening.

Example 3. HFCs/TDE with Alcohol and Phosphate Ester Used to Clean No-Clean Solder Pastes as the Soiling Substance

| Trial | Cleaning Formulation (Component Type) | Cleaning Process | Observation |
|---|---|---|---|
| 16 | 100% SDG (HHC) | 10 minutes boil | Paste mostly removed but significant dull gray residue left behind. |
| 17 | 100% Vertrel ® SFR (HHC, ALC) | 10 minutes boil | Paste mostly removed but some dull gray residue left behind. |
| 18 | 97% Vertrel ® SFR 3% Rhodafac RS710 (HHC, FAPE, ALC) | 10 minutes boil/ 1 minute rinse with SFR | Piece completely clean and metal and solder brightened. |

Trials 16 and 17 of Example 3 show that SDG and Vertrel® SFR are close in cleaning capabilities. Both have high transdichloroethylene ("TDE") content that removes organic soils readily. (SDG is 83% TDE and Vertrel® SFR is 67% TDE. However, Trial 16 left behind significant dull gray ionic residues.) The addition of alcohol to the Vertrel® SFR (Trial 17) somewhat improves the removal of ionic residues but still left some residue. However, the addition to Vertrel® SFR of the free acid phosphate ester (Trial 18) enabled attainment of a fully cleaned and brightened part.

Example 4. HFEs/TDE with Alcohol and with Phosphate Ester Used to Clean No-Clean Solder Pastes as the Soiling Substance

| Trial | Cleaning Formulation (Component Type) | Cleaning Process | Observation |
|---|---|---|---|
| 19 | 50% methoxy-nonafluoro-butane HFE7100 and 50% TDE. (HFE, HHC) | 10 minutes boil | Paste hardly removed with significant residue left behind. |
| 20 | 52.7% methoxy-nonafluoro-butane HFE7100 and 44.6% TDE. 2.7% ethanol (HFE, HHC, ALC) | 10 minutes boil | Some lifting of the residue around the solder bumps but not much removal. |
| 21 | 52.7% methoxy-nonafluoro-butane HFE7100 and 44.6% TDE. 2.7% ethanol 3% Rhodafac RS710 (HFE, FAPE) | 10 minutes boil/ 1 minute rinse with HFE71DA | Piece completely clean and metal and solder brightened. |

Trial 21 of Example 4 shows that the same satisfactory results of Trial 18 of Example 3 are obtained with hydrofluoroethers as the base component of a free acid phosphate ester. The results of Trials 19 and 20 using hydrofluoroethers are comparable to those of Trials 16 and 17 of Example 3.

Example 5. "NPB" (n-Propylbromide) with Alcohol and Free Acid Phosphate Ester Used to Clean No-Clean Solder Pastes as the Soiling Substance

| Trial | Cleaning Formulation (Component Type) | Cleaning Process | Observation |
|---|---|---|---|
| 22 | 100% NPB (n-propyl bromide) (HHC) | 10 minutes boil | Large amount of gray solids remain. |
| 23 | 95% NPB (n-propyl bromide) 5% isopropanol (HHC, ALC) | 10 minutes boil | A little more residue removed than was removed in Trial 22. |
| 24 | 94.5% NPB (n-propyl bromide) 5% isopropanol 0.5% Rhodafac RS710 (HHC, ALC, FAPE) | 10 minutes boil/ 1 minute rinse with NPB. | Piece completely clean and metal and solder brightened. |

Trial 24 of Example 5 shows that the same results as obtained in Trial 21 of Example 4 are obtained using brominated solvents as the base component.

Example 6. "HFC" (Hydrofluorocarbon Organic Solvent with Alcohol and Free Acid Phosphate Ester Used to Clean No-Clean Solder Pastes as the Soiling Substance

| Trial | Cleaning Formulation (Component Type) | Cleaning Process | Observation |
|---|---|---|---|
| 25 | 50% Vertrel ® XF 50% dipropylene glycol monomethyl ether (HHC, NHH) | 10 minutes boil/ 2 minutes rinse in XF | Large amounts of gray residue around solder bumps. |

-continued

| Trial | Cleaning Formulation (Component Type) | Cleaning Process | Observation |
|---|---|---|---|
| 26 | 52% Vertrel ® XF 43% dipropylene glycol monomethyl ether 5% benzyl alcohol (HHC, ALC) | 10 minutes boil/ 2 minutes rinse in Vertrel ® XF | Paste mostly removed but some white residue left. Slight improvement in cleaning as compared to Trial 25. |
| 27 | Trial 26 composition with 3% Capstone FS-66 added, with Vertrel ® XF reduced to 50% and the ether reduced to 42%. (HHC, ALC, FAPE) | 10 minutes boil/ 2 minutes rinse in Vertrel ® XF | Piece completely clean and metal and solder brightened. |

Trial 27 of Example 6 illustrates the successful use of an organic solvent instead of TDE (Trans-Dichloroethylene) used in earlier fluorinated systems to remove or soften the rosin portion of the flux. Trial 27 also shows that the addition of alcohol and free acid phosphate ester provided a composition which successfully fully removed no-clean fluxes.

The following examples A-H each describe a range of ingredients and quantities of various cleaning solvent compositions in accordance with aspects of the present invention. Specific compositions used in some of the Trials described above were selected from these examples, the compositions of which are defined in the indicated claims.

Example A

The composition of Trial 6 was selected from this example.

| Ingredient | Weight Percent of the Composition |
|---|---|
| Halogenated Hydrocarbon Solvent<br>one or both of trans-chlorodifluormethyl propene and cis-chlorodifluoromethyl propene | about 50 to about 96 |
| Alcohol<br>one or more straight and branched chain alkyl alcohols, aromatic and heteroaromatic alcohols, all having from 1-20 carbon atoms | about 2 to about 15 |
| Phosphate Ester Surfactant (Acid Form)<br>one or more of alkoxylated alkyl and aryl substituted phosphate esters, alkoxylated phosphate esters, fluorinated alkyl and aromatic phosphate esters, and alkyl and aromatic substituted phosphate esters | about 0.2 to about 15 |

Example B

The composition of Trial 7 was selected from this example.

| Ingredient | Weight Percent of the Composition |
|---|---|
| Halogenated Hydrocarbon Solvent<br>trans-chlorodifluormethyl propene | about 92 to about 96 |
| Alcohol<br>methanol | about 2 to about 4 |
| Phosphate Ester Surfactant (Acid Form)<br>a fluorinated alkyl-substituted phosphate ester | about 2 to about 4 |

Example C

The composition of Trials 13 and 18 was selected from this example.

| Ingredient | Weight Percent of the Composition |
|---|---|
| Halogenated Hydrocarbon Solvent<br>a blend of from about 66 to about 68 weight percent of trans-dichloroethylene, about 17 to about 19 weight percent of 2,3-dihydrodecafluoropentane, about 11 to about 13 weight percent of heptafluorocyclopentane and about 1 to about 4 weight percent methanol | about 96 to about 98 |
| Alcohol<br>The alcohol is included in the halogenated hydrocarbon solvent blend. | |
| Phosphate Ester Surfactant (Acid Form)<br>an ethoxylated alkyl-substituted phosphate ester | about 2 to about 4 |

Example D

The composition of Trial 15 was selected from this example.

| Ingredient | Weight Percent of the Composition |
|---|---|
| Halogenated Hydrocarbon Solvent<br>a blend of about 40 to about 44 weight percent of trans-dichloroethylene, about 17 to about 19 weight percent of the hydrofluorocarbon 1,1,1,3,3-pentafluorobutane (HFC 365), from about 36 to about 38 weight percent dihydrodecafluoropentane and from about 3 to about 4 weight percent methanol | about 96 to about 98 |
| Alcohol<br>The alcohol is included in the halogenated hydrocarbon solvent blend. | |
| Phosphate Ester Surfactant (Acid Form)<br>an ethoxylated alkyl-substituted phosphate ester | about 2 to about 4 |

Example E

The composition of Trial 21 was selected from this example.

| Ingredient | Weight Percent of the Composition |
|---|---|
| Halogenated Hydrocarbon Solvent<br>a blend of from about 51 to about 56 weight percent hydrofluoroether selected from one or more of methoxy-nonafluorobutane, ethoxy-nonafluorobutane, 2-trifluoromethyl-3-ethoxydodecofluorohexane and 3-ethoxy-1,1,1,2,3,4,4,5,6,6,6-dodecafluoro-2-trifluoromethyl-hexane, about 42 to about 48 weight percent trans-dichloroethylene and about 2 to about 4 weight percent ethanol | about 94 to about 98 |
| Alcohol<br>The alcohol is included in the halogenated hydrocarbon solvent blend. | |
| Phosphate Ester Surfactant (Acid Form)<br>an ethoxylated alkyl-substituted phosphate ester | about 2 to about 4 |

Example F

The composition of Trial 24 was selected from this example.

| Ingredient | Weight Percent of the Composition |
|---|---|
| Halogenated Hydrocarbon Solvent<br>n-propyl bromide | about 70 to about 97 |
| Alcohol<br>isopropanol | about 4 to about 25 |
| Phosphate Ester Surfactant (Acid Form)<br>an ethoxylated alkyl-substituted phosphate ester | about 0.4 to about 0.5 |

Example G

The composition of Trial 27 was selected from this example.

| Ingredient | Weight Percent of the Composition |
|---|---|
| Halogenated Hydrocarbon Solvent<br>one or more hydrofluorocarbons | about 48 to about 54 |
| Alcohol<br>benzyl alcohol | about 4 to about 6 |
| Phosphate Ester Surfactant (Acid Form)<br>a fluorinated alkyl-substituted phosphate ester | about 2 to about 4 |
| Non-Halogenated Hydrocarbon Solvent<br>dipropylene glycol monomethyl ether | About 36 to about 44 |

Example H

One or more of methanol, ethanol, isopropanol and n-butanol is substituted for the alcohol component of Examples A-G.

While the invention has been described in detail with reference to specific embodiments, it will be appreciated that numerous variations may be made to the described embodiment, which variations nonetheless lie within the scope of the present invention.

What is claimed is:

1. A composition comprising from about 2 to about 4 weight percent of one or more free acid forms of ethoxylated alkyl-substituted phosphate ester surfactants selected from the group consisting of one or both of:

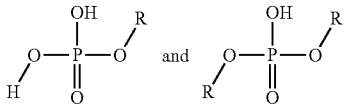

wherein R is selected from the group consisting of one or more of ethoxylated hydrocarbons, alkylated hydrocarbons, fluorinated hydrocarbons, and ethoxylated and fluorinated hydrocarbons;

from about 2 to about 25 weight percent of an alcohol selected from the group consisting of one or more of straight chain and branched alkyl alcohols, monohydric and polyhydric aromatic alcohols and monohydric and polyhydric heteroaromatic alcohols; and from about 25 to about 97.8 weight percent of one or more halogenated hydrocarbon solvents, and wherein the halogenated hydrocarbon solvents comprise a blend of from about 66 to about 68 weight percent of trans-dichloroethylene, about 17 to about 19 weight percent of 2,3-dihydrodecafluoropentane, about 11 to about 13 weight percent of hepta-fluorocyclopentane and about 1 to about 4 weight percent of an alcohol selected from one or more of straight and branched chain alkyl alcohols, aromatic and heteroaromatic alcohols, all having from 1-20 carbon atoms and is present in the amount of from about 2 to about 15 weight percent of the composition, the blend being present in the amount of from about 96 to about 98 weight percent of the composition.

2. The composition of claim 1 wherein the alcohol comprises methanol.

3. The composition of claim 1 wherein R is one or more of

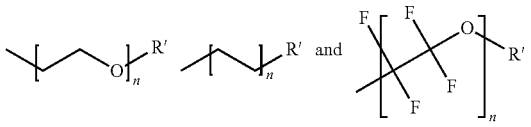

R' is one or more of H, $CH_3$, an alkyl group and an aryl group; and n is an integer from 2 to 20.

4. A composition comprising from about 2 to about 4 weight percent of one or more free acid forms of ethoxylated alkyl-substituted phosphate ester surfactants selected from the group consisting of one or both of:

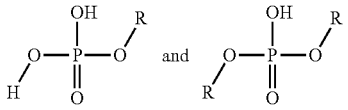

wherein R is one or more of

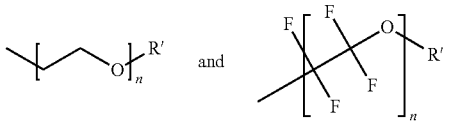

wherein R' is one or more of H, $CH_3$, an alkyl group and an aryl group; and n is an integer from 2 to 20;

from about 2 to about 25 weight percent of an alcohol selected from the group consisting of one or more of straight chain and branched alkyl alcohols, monohydric and polyhydric aromatic alcohols and monohydric and polyhydric heteroaromatic alcohols; and from about 25 to about 97.8 weight percent of one or more halogenated hydrocarbon solvents and wherein:

the halogenated hydrocarbon solvent comprises a blend of about 40 to about 44 weight percent of trans-dichloroethylene, about 17 to about 19 weight percent of the hydrofluorocarbon pentafluorobutane, from about 36 to about 38 weight percent dihydrodecafluoropentane and from about 3 to about 4 weight percent methanol, the blend being present in the amount of from about 96 to about 98 weight percent of the composition.

5. The composition of claim 4 wherein the pentafluorobutane comprises 1,1,1,3,3-pentafluorobutane.

6. A composition comprising from about 1 to about 6 weight percent of one or more free acid forms of ethoxylated alkyl-substituted phosphate ester surfactants selected from the group consisting of:

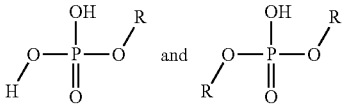

wherein R is selected from the group consisting of one or more of ethoxylated hydrocarbons, alkylated hydrocarbons, fluorinated hydrocarbons, and ethoxylated and fluorinated hydrocarbons; and from about 85 to about 97.8 weight percent of a halogenated hydrocarbon solvent, wherein the halogenated hydrocarbon solvent is selected from the group consisting of one or more of perfluorocarbons ("PFCs"), chlorofluorocarbons ("CFCs"), hydrofluorocarbons ("HFCs"), hydrofluoroethers ("HFEs"), hydrofluoroolefins ("HFOs"), partially brominated hydrocarbons, fully brominated hydrocarbons, partially chlorinated hydrocarbons and fully chlorinated hydrocarbons and wherein:

the halogenated hydrocarbon solvent comprises a blend of from about 80 to about 86 weight percent trans-dichloroethylene, from about 5 to about 9 weight percent 2,3-dihydrodecafluoropentane and from about 8 to about 12 weight percent hexafluorocyclopentane, the blend being present in the amount of from about 94 to about 99 weight percent of the composition.

7. The composition of claim 6 wherein R is one or more of

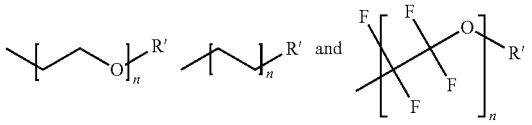

R' is one or more of H, $CH_3$, an alkyl group and an aryl group; and n is an integer from 2 to 20.

8. A composition comprising from about 2 to about 4 weight percent of one or more free acid forms of an ethoxylated alkyl-substituted phosphate ester surfactant selected from the group consisting of:

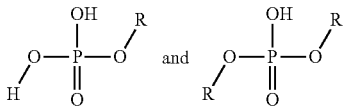

wherein R is selected from the group consisting of one or more of ethoxylated hydrocarbons, alkylated hydrocarbons, fluorinated hydrocarbons, and ethoxylated and fluorinated hydrocarbons; and from about 85 to about 97.8 weight percent of a halogenated hydrocarbon solvent comprising a blend of about 40 to about 44 weight percent of trans-dichloroethylene, about 17 to about 19 weight percent of the hydrofluorocarbon pentafluorobutane, from about 36 to about 38 weight percent dihydrodecafluoropentane and from about 3 to about 4 weight percent methanol, the blend being present in the amount of from about 96 to about 98 weight percent of the composition.

9. The composition of claim 8 wherein the pentafluorobutane comprises 1,1,1,3,3-pentafluorobutane.

* * * * *